US005615845A

United States Patent [19]

Kewin

[11] Patent Number: 5,615,845

[45] Date of Patent: Apr. 1, 1997

[54] TUBULAR CORE ASSEMBLIES FOR ROLLS OF PAPER OR OTHER SHEET MATERIAL

[76] Inventor: Daniel D. Kewin, 16 Dogwood Drive, Brantford, Ontario, Canada, N3R 1R3

[21] Appl. No.: 624,347

[22] Filed: Apr. 3, 1996

[51] Int. Cl.[6] ..... B65H 75/10; B65H 75/30

[52] U.S. Cl. ..... 242/613.5

[58] Field of Search ..... 242/613.5, 613.4, 242/611.2, 611, 614, 614.1, 610.4, 912

[56] References Cited

U.S. PATENT DOCUMENTS

| | | | |
|---|---|---|---|
| 1,941,495 | 1/1934 | Schoultheis | 242/613.5 |
| 3,713,601 | 1/1973 | Buhrman et al. | 242/611.2 |
| 3,833,109 | 9/1974 | Landgraf | 242/611.2 |
| 5,236,141 | 8/1993 | Kewin | 242/613.5 |
| 5,393,010 | 2/1995 | Renck | 242/613.5 |

*Primary Examiner*—John M. Jillions
*Attorney, Agent, or Firm*—Rogers & Scott

[57] ABSTRACT

An annular end member of plastic material for insertion into an end portion of a hollow cylindrical core member of a tubular core assembly for a roll of paper or other sheet material has an outer annular surface securable to an inner annular surface of the core member and an inner annular surface shaped to receive a roll supporting chuck. A radially-projecting lug adjacent an end of the end member is engageable in a lug-receiving notch in the core member, and a plurality of circumferentially-spaced axially-extending channels are provided in the inner annular surface of the end member to receive radially outwardly movable portions of a chuck. The channels have side walls engageable by the radially moveable chuck portions to enable rotational movement of the chuck to be transmitted to the end member. The end member can be constructed so as to be a universal fit on various different types of chuck.

30 Claims, 1 Drawing Sheet

TUBULAR CORE ASSEMBILIES FOR ROLLS OF PAPER OR OTHER SHEET MATERIAL

Figure 1:
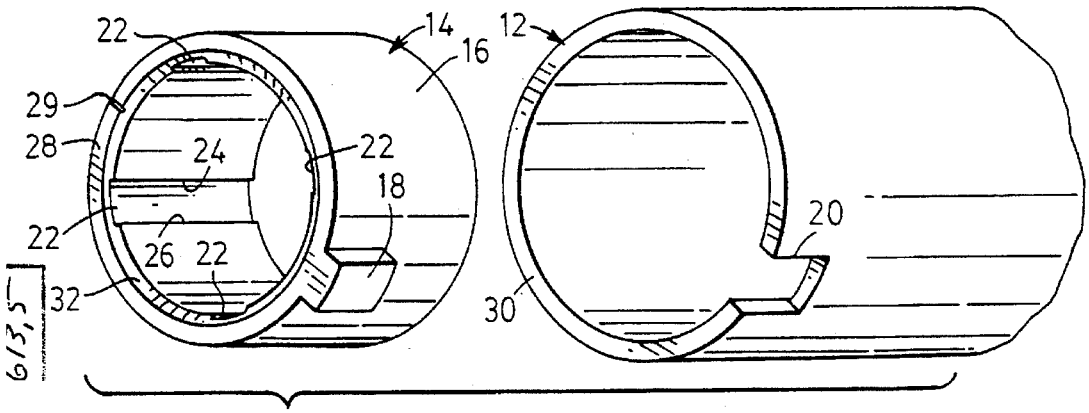

This invention relates to tubular core assemblies for rolls of paper or other sheet material.

Tubular core assemblies which have a hollow cylindrical core member of paperboard material and an annular end member of plastic material within each opposite end portion of the core member are known, see for example U.S. Pat. No. 5,236,141 issued Aug. 17, 1993 and pending application Ser. No. 08/541,281 filed Oct. 12, 1995, the contents of which are hereby incorporated herein by reference.

The end members of such tubular core assemblies can be readily separated without damage from the core member after use. The end members can thus be re-used and the core member can be recycled, for example by crushing and repulping. Further, not only can parts of such a tubular core assembly be readily reused or recycled, but also the tubular core assembly combines the advantages of a relatively thin walled core member with the strength of a plastic end member which is sufficient to withstand extreme transit impact without the support of an end plug. The ready separability of the end members also enables them to be replaced before roll installation in a reel if they should have become damaged during transit from the paper roll manufacturer or during mounting on the stub chucks of the reel.

Tubular core assemblies of the kind referred to above have proved to be successful both in paper production mills where paper is wound onto the tubular core assembly and in the printing industry where paper is unwound and fed to printing presses. However, practical use in the printing industry has highlighted some problems which are encountered not only by such tubular core assemblies but also by other type of tubular core assemblies.

There are various different kinds of roll mounting chucks currently in use in the printing industry. Some chucks have a single key which engage in a notch in the tubular core assembly, some chucks have radially movable portions which are movable radially outwardly to engage the inner surface of the tubular core assembly, and other chucks are moved under axial pressure into engagement with the end of the tubular core assembly. Conventional core assemblies have end reinforcements and/or configurations specific to the type of unwinding chuck on which they are to be mounted. This results in a requirement for a large inventory of different core assemblies and paper rolls. Also, conventional core assemblies have fibre material engaging steel portions of unwinding chucks. The fibre material is subject to chew out and distortion by metal chuck keys and splines (radially movable portions), and metal end reinforcements cannot be effectively gripped by metal splines.

A typical pressroom may have printing presses with different types of chucks. Thus, ideally, a tubular core assembly should be capable of use with such different types of chucks. Also, they should be user friendly, i.e relatively easy for an operator to correctly engage the chucks with the tubular core assembly of a new paper roll. New and therefore fully wound paper rolls may have a weight of about 3,000 lbs., a length of about 5 ft., and a diameter of about 4 ft., and are not easily manoeuvred.

One of the practical difficulties encountered by a pressroom operator when installing a new paper roll of single keyed chucks at an unwinding station, appears when the ends of the tubular core assembly of the roll have a single key receiving notch as is the case with conventional paper mill cores. When the new roll is moved in to position, there is at least a 50/50 chance that the notch at the key receiving end of the tubular core assembly will be in the lower half of the roll, and hence not readily visible to the operator who has to align the chuck key with the notch at the end of the roll before the chucks are engaged therewith. Misalignment between a chuck key and a notch in and end of the tubular core assembly can cause serious damage to the tubular core assembly with the result that the roll may not be able to be used, or may have to be run at reduced speeds. Resultant waste of time and financial loss is self-evident.

According to the invention which is the subject of application Ser. No. 08/541,281, each end member has a pair of radially-projecting lugs at diametrically opposite positions for engagement in lug receiving notches in the core member, and a pair of notches at diametrically opposite positions for receiving a projection of a roll supporting chuck, the projection receiving notches being located circumferentially mid-way between the pair of lugs.

Thus, one of the projection-receiving notches, i.e. chuck key receiving notches, will always be in the top half of the roll, therefore being readily visible to a pressroom operator installing a new roll at an unwinding station and substantially eliminating the risk of misalignment between the key chuck and the notch during the installation operation.

Another practical difficulty occurs when a new paper roll with a tubular core assembly of the kind mentioned above is installed on chucks which have radially movable portions which are movable radially outwardly to engage the inner surfaces of the plastic end members. The radial force with which the radially movable portions of the chuck engage the inner surface of a plastic end member has to be sufficient to enable rotation of the chuck to be transferred to the end member without slipping. Much conventional unwinding equipment was designed to interface steel expansion bars on the chucks with iron cores. The high radial force .necessary for this purpose is transmitted through the end member to the core member, which is now usually formed of multiple wraps of paperboard material. Such transmitted radial force may cause separation of the wraps of paperboard material, with resultant poor performance when in use.

It is therefore an object of the invention to provide an end member of plastic material which at least substantially overcomes this problem.

According to the invention, each end member has a radially-projecting lug adjacent an end thereof engageable in a lug-receiving notch in a core member, and a plurality of circumferentially-spaced axially-extending channels in its annular surface to receive radially outwardly movable portions of a chuck, said channels having side walls engageable by said chuck portions to enable rotational movement of the chuck to be transmitted to the end member, and said channels being circumferentially positioned in relationship to at least one feature of the core assembly which is visible to an operator when mounting the core assembly on the chuck, whereby observation of said feature indicates the position of said channels to the operator.

Thus, with end members in accordance with the invention, it is no longer necessary for the radially movable portions of the chuck to engage the annular member with such force as before since, with the invention, rotational force is transmitted from the chuck to the end member by engagement of the radially movable chuck portions with the side walls of the channels instead of relying on frictional engagement between the radially movable portions and the end member as before. Also, when mounting on the chuck, the position of the channels can readily be ascertained by observation of one of the features visible to the operator.

The end member may have an end surface with a radially inwardly and rearwardly bevelled radially inner portion for engagement by a chuck inserted in to the end member, the bevelled portion having a radial depth from the inner annular surface of the end member greater than the radial depth of the channels.

The end member may have four axially extending channels equi-angularly spaced around the inner annular surface of the end member, and the lug may be located at a position circumferentially midway between a pair of adjacent channels.

The end member may have a notch extending inwardly from the end for receiving a projection of a roll supporting chuck, and the notch may be located at a position circumferentially midway between a pair of adjacent channels.

The end member may have a pair of lugs at diametrically opposite positions, each lug being at a position circumferentially midway between a respective pair of adjacent channels, the end member also having a pair of diametrically opposite notches extending inwardly from the end for receiving a projection of a roll supporting chuck, each projection-receiving notch being located circumferentially mid-way between the pair of lugs.

Preferably, the channels extend along the whole axial length of the end member from one end to the other.

Figure 2:
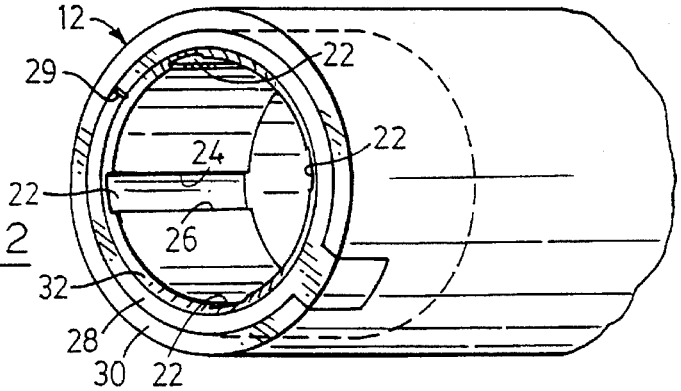
Figure 3:
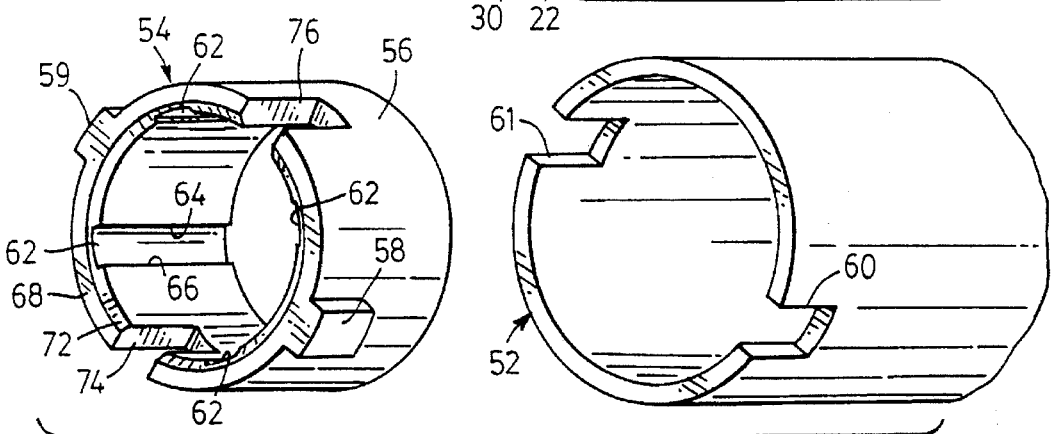
Figure 4:
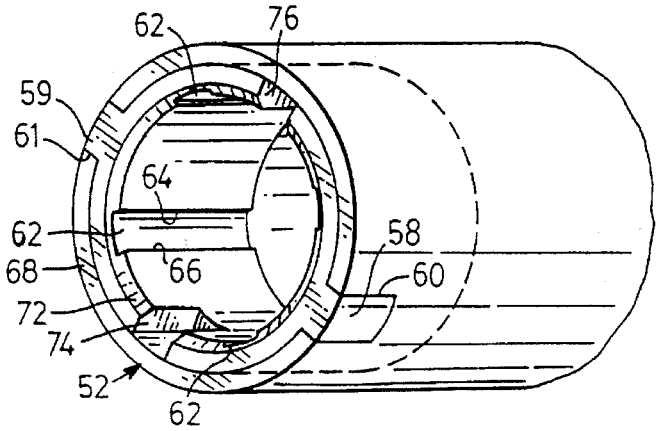

Embodiments of the invention will now be described, with reference to the accompanying drawings, of which:

FIG. 1 is an exploded view of one end portion of a tubular core assembly in accordance with the invention, FIG. 2 is a perspective view of the tubular core assembly of FIG. 1 in an assembled condition, FIG. 3 is an exploded view of one end portion of a tubular core assembly in accordance with a second embodiment, and FIG. 4 is a perspective view of the tubular core assembly of FIG. 3 in an assembled condition.

Referring to the drawings, FIGS. 1 and 2 show one end portion of a tubular core assembly for a paper roll which comprises a hollow cylindrical core member 12 of paperboard material, and an annular end member 14 of synthetic plastic material with a sleeve portion 16 within each opposite end portion of the core member 12. The core member 12 has multiple spirally-wound wraps (i.e. laminated plies) of paperboard material, and the synthetic plastic material may be of suitable polymeric such as injection molding grade 25% glass filled nylon type 6.

The sleeve portion 16 of each end member 14 has an outer annular surface which is a compression fit, i.e. a friction fit, in a respective end portion of the core member 12. Each end member 14 has a lug 18 rectangular section projecting radially outwardly from the end of the sleeve portion 16 at the end of the core member 12. The lug 18 is located in a notch 20 of rectangular section in the end of the core member 12, and facilitates the transmission of torque and axial pressure from the end members 14 to the core member 12.

The sleeve portion 16 of each end member 14 has four equi-angularly spaced axially-extending channels 22 in its inner annular surface to receive radially outwardly movable portions of a chuck (not shown), the nature of which is well known to those skilled in the art. Each channel 22 extends along the whole axial length of the end member 14 from one end to the other thereof, and has side walls 24, 26 engageable by the radially movable chuck portions to enable rotational movement of the chuck to be transmitted to the end member 14 and hence to the core member 12. The lug 18 is located at a position circumferentially midway between a pair of adjacent channels 22.

Each end member 16 also has an end surface 28 adjacent the respective end 30 of the core member 12, and the end surface 28 has a radially inwardly and rearwardly bevelled radially inner portion 32 for engagement by a chuck (not shown) inserted into the end member 16. The bevelled portion 32 has a radial depth from the inner annular surface of the end member 16 greater than the radial depth of the channels 22. A radially extending notch 29 is provided in the end surface 28 diametrically opposite the lug 18.

Each end member 14 has an internal diameter in the range of from about 3 to about 6 inches, an outer diameter in the range of from about 3.5 to about 7 inches, and a length in the range of from about 1.5 to about 6 inches. The core member 12 has an outer diameter in the range of from about 4 to about 9 inches, and a length in the range of from about 2 to about 10 feet. The ratio of end member wall thickness to core member thickness is in the range of from about 0.75:1 to about 1.5:1.

Each channel has a width in the range of from about 0.5 to about 1.5 inches and a depth in the range of from 0.156 (1/64) to about 0.375 (3/8) inches. The lug 18 has a height above the outer annular surface of the end member 14 in the range of from about 0.2 to about 1 inch, a circumferential width in the range of from about 0.75 to about 3 inches, and an axial length in the range of from about 0.5 to about 4 inches.

In a specific example of the invention, the sleeve portion 16 of each end member 14 has an internal diameter of 3 inches, an external diameter of 3.75 inches and a length of 3 inches. The core member 12 has an outer diameter of 4.4 inches and a length of 4.5 feet. The ratio of end member wall thickness to core member thickness of 1.15:1. Each channel 22 has a width of 1.25 inches and a depth of 0.0625 (1/16) inches.

It would be noted that the tubular core assembly described with reference to FIGS. 1 and 2 can be used both with chucks which have radially movable portions which are moved radially outwardly to enter the channels 22, and chucks which are moved under axial pressure into engagement with the bevelled portion 32 on the end face 28 of the end member 14. When mounting the core assembly on a chuck, the lug 18 or the notch 29 will be visible to the operator, thereby informing the operator of the location of the channels 22.

FIGS. 3 and 4 show a further embodiment which is generally similar to the prior embodiment, except that the sleeve portion 56 of each end member 54 has a further radially outwardly projecting lug 59 diametrically opposite to the lug 58, and also has a pair of diametrically opposite notches, 74, 76 circumferentially mid-way between the lug 58, 59. The core member 52 has a further notch 61 diametrically opposite the notch 60, the notches 60, 61 receiving the lugs 58, 59 respectively. As before, the sleeve portion 56 of each end member 54 has four channels 62 and a bevelled portion 72 in its end face 68, the channels 62 having side wails, 64, 66.

It will be noted that the embodiment described with reference to FIGS. 3 and 4 is also suitable for use with chucks having a single key which can engage in either of the notches 74, 76 as well as with chucks with radially movable portions and chucks which engage an end of the end member with axial pressure. This end member 54 can therefore be regarded as a "universal" end member. Also, when mounting the core assembly on a chuck, the lug 58, the lug 59, the notch 74 or the notch 76 will be visible to the operator, thereby informing the operator of the position of the channels 62.

The provision of a plastic contact with steel chucks provides a material which is hard but sufficiently resilient to be indented for grip by chuck splines. Such a resilient end member also effectively increases the load interfaces between the end member and the core member, thereby reducing shear stress on a paperboard core member. This lessens the likelihood of paperboard ply separation which would, if present, cause poor dynamic spin performance.

The polymeric characteristics of plastic end members are also similarly effective in absorption and distribution of impact loads during transit, in contrast to shorter conventional plugs which act as anvils against which fibre core ends are hammered.

Other embodiments of the invention will be readily apparent to a person skilled in the art, the scope of the invention being defined in the appended claims.

I claim:

1. A tubular core assembly for a roll of paper or other sheet material comprising:

a hollow cylindrical core member formed of paperboard material, and an annular end member of plastic material within each opposite end portion of the core member, each end member having an outer annular surface secured to the inner annular surface of the core member and an inner annular surface shaped to receive a roll supporting chuck, each end member having a radially-projecting lug at the respective end of the tubular core assembly, said core member having a lug-receiving notch at each end receiving said lug of the respective end member to facilitate transmission of torque and axial chuck pressure from the end member to the core member, and each end member having a plurality of circumferentially-spaced axially-extending channels in its inner annular surface to receive radially outwardly movable portions of a chuck, said channels including bottom portions extending axially and having side walls engageable by said chuck portions to enable rotational movement of the chuck to be transmitted to the end member, and said channels being circumferentially positioned in relationship to at least one feature of the core assembly which is visible to an operator when mounting the core assembly on the chuck, whereby observation of said feature indicates the position of said channels to the operator.

2. A tubular core assembly according to claim 1 wherein each end member has an end surface adjacent the respective end of the core member having a radially inwardly and rearwardly bevelled radially inner portion for engagement by a chuck inserted into the end member.

3. A tubular core assembly according to claim 2 wherein said bevelled portion has a radial depth from the inner annular surface of the end member greater than the radial depth of the channels.

4. A tubular core assembly according to claim 1 wherein each end member has four said axially extending channels equi-angularly spaced around the inner annular surface of the end member.

5. A tubular core assembly according to claim 4 wherein said lug is located at a position circumferentially mid-way between a pair of adjacent channels.

6. A tubular core assembly according to claim 1 wherein each end member has a notch extending inwardly from the respective end of the tubular core assembly for receiving a projection of a roll supporting chuck.

7. A tubular core assembly according to claim 6 wherein the notch is located at a position circumferentially mid-way between a pair of adjacent channels.

8. A tubular core assembly according to claim 4 wherein each end member has a pair of said lugs at diametrically opposite positions, each lug being at a position circumferentially mid-way between a respective pair of adjacent channels, each end member also having a pair of diametrically opposite notches extending inwardly from the respective end of the tubular core assembly for receiving a projection of a roll supporting chuck, each projection-receiving notch being located at a position circumferentially mid-way between the said pair of lugs.

9. A tubular core assembly according to claim 8 wherein each end member has an end surface adjacent to the respective end of the core member having a radially inwardly and rearwardly bevelled radially inner portion for engagement by a chuck inserted into the end member.

10. A tubular core assembly according to claim 9 wherein said bevelled portion has a radial depth from the inner annular surface of the end member greater than the radial depth of the channels.

11. A tubular core assembly according to claim 1 wherein the channels extend along the whole axial length of the end members from one end to the other end thereof.

12. An annular end member of plastic material for insertion into an end portion of a hollow cylindrical core member of a tubular core assembly for a roll of paper or other sheet material, each end member having an outer annular surface securable to an inner annular surface of a core member and an inner annular surface shaped to receive a roll supporting chuck, a radially-projecting lug adjacent an end thereof engageable in a lug-receiving notch in a core member, and a plurality of circumferentially-spaced axially-extending channels in its annular surface to receive radially outwardly movable portions of a chuck, said channels including bottom portions extending axially and having side walls engageable by said chuck portions to enable rotational movement of the chuck to be transmitted to the end member.

13. An annular end member according to claim 12 and having an end surface at said end with a radially inwardly and rearwardly bevelled radially inner portion for engagement by a chuck inserted into the end member.

14. An annular end member according to claim 13 wherein said bevelled portion has a radial depth from the inner annular surface of the end member greater than the radial depth of the channels.

15. An end member according to claim 2 having four said axial extending channels equi-angularly spaced around the inner annular surface of the end member.

16. An annular end member according to claim 15 wherein said lug is located at a position circumferentially mid-way between a pair of adjacent channels.

17. An annular end member according to claim 15 having a pair of said lugs at diametrically opposite positions, each lug being at a position circumferentially mid-way between a respective pair of adjacent channels, the end member also having a pair of diametrically opposite notches extending inwardly from said end for receiving a projection of a roll supporting chuck, each projection-receiving notch being located circumferentially mid-way between said pair of lugs.

18. An annular end member according to claim 12 having a notch extending inwardly from said end for receiving a projection of a roll supporting chuck.

19. An annular end member according to claim 18 wherein the notch is located at a position circumferentially mid-way between a pair of adjacent channels.

20. An annular end member according to claim 12 wherein the channels extend along the whole axial length of the end member from one end to the other.

21. An annular end member according to claim 12 wherein said end member has an internal diameter in the range of from about 3 to about 6 inches, an outer diameter in the range of from about 3.5 to about 7 inches and a length in the range of from about 1.5 to about 6 inches, and each channel has a width in the range of from about 0.5 to about 1.5 inches and a depth in the range of from about 0.156 to about 0.375 inches.

22. An annular end member according to claim 21 having an end surface at said end with a radially inwardly and rearwardly bevelled radially inner potion for engagement by a chuck inserted into the end member.

23. An annular end member according to claim 22 wherein said bevelled potion has a radial depth from the inner annular surface of the end member greater than the radial depth of the channels.

24. An end member according to claim 21 having four said axial extending channels equi-annularly spaced around the inner annular surface of the end member.

25. An annular end member according to claim 24 wherein said lug is located at a position circumferentially mid-way between a pair of adjacent channels, said lug having a height about the outer annular surface in the range of from about 0.2 to about 1 inch, a circumferential width in the range of from about 0.75 to about 3 inches, and an axial length in the range of from about 0.5 to about 4 inches.

26. An annular end member according to claim 21 having a notch extending inwardly from said end for receiving a projection of a roll supporting chuck, said notch having a circumferential width in the range of from about 0.25 to about 1 inch and an axial length in the range of from about 0.5 to about 4 inches.

27. An annular end member according to claim 26 wherein the notch is located at a position circumferentially mid-way between a pair of adjacent channels.

28. An annular end member according to claim 24 having a pair of said lugs at diametrically opposite positions, each lug being at a position circumferentially mid-way between a respective pair of adjacent channels, the end member also having a pair of diametrically opposite notches extending inwardly from said end for receiving a projection of a roll supporting chuck, each projection-receiving notch being located circumferentially mid-way between said pair of lugs.

29. An annular end member according to claim 21 wherein the channels extend along the whole axial length thereof from one end to the other.

30. An annular end member according to claim 12 wherein a visible marking is provided on said end diametrically opposite said lug.

* * * * *